United States Patent [19]

Davis, Jr.

[11] 4,094,267

[45] June 13, 1978

[54] DISTRESS SIGNAL DEVICE

[76] Inventor: John Davis, Jr., Rte. 1, Box 172D, Eatonville, Wash. 98328

[21] Appl. No.: 787,441

[22] Filed: Apr. 14, 1977

[51] Int. Cl.[2] ..... G09F 9/00

[52] U.S. Cl. ..... 116/124 B; 116/DIG. 9; 141/317

[58] Field of Search ..... 116/124 B, DIG. 9; 141/317

[56] References Cited

U.S. PATENT DOCUMENTS

| | | | |
|---|---|---|---|
| 1,329,584 | 2/1920 | DeMarinis | 116/124 B |
| 2,862,531 | 12/1958 | Walker | 141/317 |
| 3,381,655 | 5/1968 | Rozzelle | 116/124 B |
| 3,425,390 | 2/1969 | Salmi | 116/124 B |
| 3,796,181 | 3/1974 | Collins | 116/124 B |
| 3,881,531 | 5/1975 | Rossi | 116/DIG. 9 |
| 3,941,079 | 3/1976 | McNeill | 116/124 B |

*Primary Examiner*—Daniel M. Yasich

[57] ABSTRACT

This device is a red or orange balloon, with white lettering spelling out the word, "HELP", on both sides. The device includes a helium tank with cord retaining means thereon, and a valve device for insertion into a sleeve secured within a fitting on the neck of the balloon, and one end of the cord is secured to the balloon, and the other end is secured to the tank, which will serve as anchor means for the balloon, when the device is in use.

1 Claim, 2 Drawing Figures

FIG.1
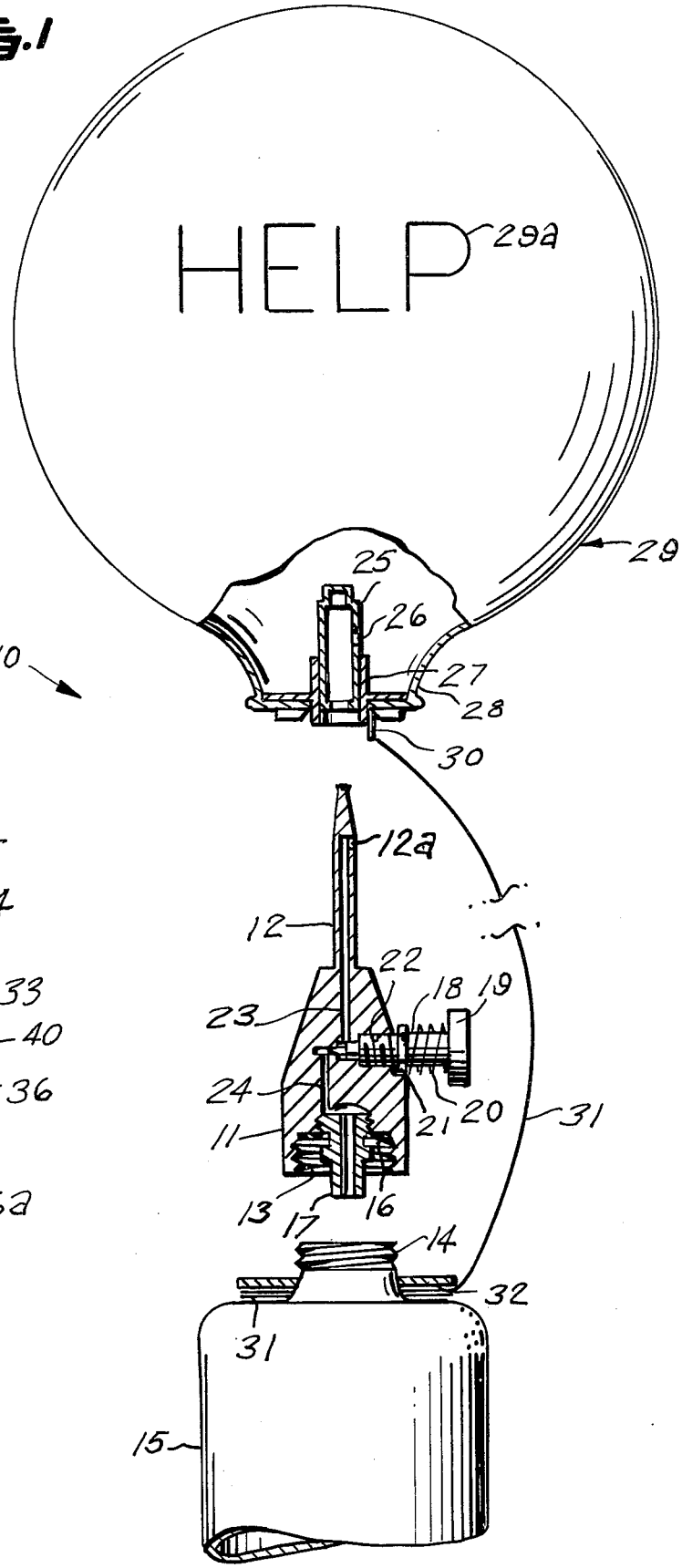
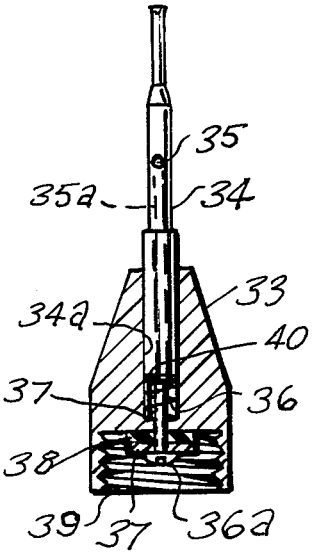
FIG.2

DISTRESS SIGNAL DEVICE

This invention relates to signal devices, and more particularly, to a distress signal device.

It is, therefore, the principal object of this invention to provide a distress signal device, which will be used to aid in locating lost or injured persons who participate in outdoor sports, such as boating, hunting, cross-country skiing, hiking, and back-packing. Another object of this invention is to provide a distress signal device, of the type described, which will be adaptable for use as a standard safety item on private and commercial airlines. The balloon portion of the device is such, that it may be easily seen from the ground or the air, and the device will help in locating, and getting the necessary assistance to, lost or injured persons in a minimum amount of time.

A further object of this invention is to provide a distress signal device, of the type described, which will have gas control valve means.

Other objects of the invention are to provide a distress signal device, which is simple in design, inexpensive to manufacture, rugged in construction, easy to use and efficient in operation.

These, and other objects, will be readily evident, upon a study of the following specification, and the accompanying drawing, wherein:

FIG. 1 is a vertical view of the present invention, shown in elevation and partly broken away; and FIG. 2 is a vertical view of a modified form of tank valve, shown in elevation, and in section.

According to this invention, a distress signal device 10 is shown to include a cylinder 11, having an extending stem 12, having a port 12*a*. At the base of cylinder 11, is an internally threaded opening 13, which threadingly engages the externally threaded neck 14 of the helium-filled tank 15. A rubber washer 16 is frictionally held within opening 13, on the exterior of a helium gas release stem 17.

A shaft 18, with a fingergrip knob 19, is threadably received in cylinder 11, and a coiled spring 20, on shaft 18, urges at one end against the knob 19, and urges, at its opposite end, against a lock nut 21. Shaft 18 is threadably received within internally threaded opening 22 of cylinder 11, and provides gas control means, by closing off or opening passageway 23 of passageway 24. Stem 12 is removably received within sleeve 25, having port 26, which will align with port 12*a* of stem 12. Sleeve 25 is slideable within fitting 17, which is fixedly secured within neck 28 of balloon 29, which is red or orange in color. Balloon 29 is thirty inches in diameter, when inflated, and the lettering 29*a* thereon is white in color, and is inscribed on both sides of balloon 29. A projection 30 of fitting 27 has secured to it, fixedly, a nylon or other cord 31, which is retained, and secured to cord retaining device 32, secured to helium tank 15, the tank 15 serving as anchor means for the balloon 29, when in use.

When sleeve 25 is in the upward position, helium gas passes out of port 12*a* of stem 12, and out of port 26 of sleeve 25. When sleeve 25 is in the downward position, port 26 is closed off by the wall of fitting 27, thus sealing the helium gas in balloon 29.

When in storage, cord 31, which is three hundred feet in length, is wound upon cord retaining device 32 of tank 15.

It shall be noted that rubber washer 16 provides sealing means for cylinder 11, against neck 14 of tank 15.

Referring now to FIG. 2 of the drawing, a modified cylinder 33 includes a stem 34, with a port 35, and the lower portion of stem 34 is slideable within opening 34*a*, of cylinder 33. The lower portion of stem 34 abuts against spring 36, which urges against the bottom of opening 34*a*. Screw 36*a*, of stem 34, abuts against a washer 37, which abuts with rubber washer 38.

The opening 39 is received upon tank 15 in the same manner as was described of FIG. 1. A rubber washer 40 of cylinder 33, in combination with washer 38, provides sealing means for gas, and when stem 34 is urged downwards, gas is released through passageway 35*a*, and out of port 35, so as to fill balloon 29.

While various changes may be made in the detail construction, it is understood that such changes will be within the spirit and scope of the present invention, as is defined by the appended claims.

What I now claim is:

1. A distress signal device, comprising a colored balloon, a fitting secured to said balloon, with a cord secured fixedly thereto, a slidable sleeve secured within said fitting for the passage of helium gas for inflating said balloon, a cylinder removably received on a tank containing said helium gas, said cylinder including an extending stem having a passageway therein, which intersects with a side port, and said side port, when said stem is received within said slidable sleeve, aligns with a port of said slidable sleeve for the passage of said helium gas into said balloon and a screw shaft is threaded into said cylinder at right angles to said passageway, said screw shaft having a knob for controlling its lateral travel, which will cover and uncover a passageway leading to an offset and connecting passageway in the base of said cylinder, and said base of said cylinder includes a washer and a hollow stem for entering the neck of said tank containing said helium gas.

* * * * *